US008885841B2

(12) United States Patent
Uchino et al.

(10) Patent No.: US 8,885,841 B2
(45) Date of Patent: Nov. 11, 2014

(54) AUDIO PROCESSING APPARATUS AND METHOD, AND PROGRAM

(75) Inventors: Manabu Uchino, Kanagawa (JP); Shusuke Takahashi, Chiba (JP); Akira Inoue, Tokyo (JP)

(73) Assignee: Sony Corporation, Tokyo (JP)

( * ) Notice: Subject to any disclaimer, the term of this patent is extended or adjusted under 35 U.S.C. 154(b) by 451 days.

(21) Appl. No.: 13/270,873

(22) Filed: Oct. 11, 2011

(65) Prior Publication Data

US 2012/0093326 A1 Apr. 19, 2012

(30) Foreign Application Priority Data

Oct. 18, 2010 (JP) ..... P2010-233908
Feb. 23, 2011 (JP) ..... P2011-037393

(51) Int. Cl.
*H04R 29/00* (2006.01)
*G10H 1/00* (2006.01)
*G10L 25/87* (2013.01)

(52) U.S. Cl.
CPC ..... *G10L 25/87* (2013.01); *G10H 1/0008* (2013.01); *G10H 2210/061* (2013.01); *G10H 2240/151* (2013.01)
USPC ..... 381/56; 84/609; 84/616; 84/611

(58) Field of Classification Search
CPC ..... H04R 29/00
USPC ..... 381/56; 700/94; 84/601, 609, 611, 616
See application file for complete search history.

(56) References Cited

U.S. PATENT DOCUMENTS

| | | | | |
|---|---|---|---|---|
| 4,589,127 | A * | 5/1986 | Loughlin | 381/16 |
| 7,050,980 | B2 * | 5/2006 | Wang et al. | 704/503 |
| 7,110,549 | B2 * | 9/2006 | Wildhagen | 381/13 |
| 8,538,566 | B1 * | 9/2013 | Bennett | 700/94 |

* cited by examiner

*Primary Examiner* — Disler Paul
(74) *Attorney, Agent, or Firm* — Sherr & Jiang, PLLC

(57) ABSTRACT

An audio processing apparatus includes an audio signal acquisition unit which acquires an audio signal of a musical piece, a feature value extraction unit which extracts a predetermined type of feature value from the audio signal acquired by the audio signal acquisition unit in time series, a change point detection unit which detects a change point in which the amount of change of the feature value extracted in time series by the feature value extraction unit is changed to be greater than a predetermined threshold value, a hook analysis unit which analyzes a hook place of the audio signal based on the feature value extracted by the feature value extraction unit in block units with the change point detected by the change point detection unit as a boundary, and a hook information output unit which outputs the hook place analyzed by the hook analysis unit as hook information.

18 Claims, 13 Drawing Sheets

AUDIO PROCESSING APPARATUS AND METHOD, AND PROGRAM

BACKGROUND

The present disclosure relates to an audio processing apparatus and method, and a program and, more particularly, to an audio processing apparatus and method, and a program, which are capable of extracting with high accuracy a hook from an audio signal formed of musical pieces.

Recently, as represented by a mobile telephone, an age of ubiquitous networking has arrived where the Internet may be accessed anywhere at any time, ways of personal enjoyment or lifestyle have diversified. Among them, if looking at music formed from musical pieces, and the like, until recently, a style of importing a purchased music album compact disc (CD) to a tape or a mini disc (MD) and listening to music using an audio player outdoors, such as on the subway or in the street, has generally been used. However, recently, as an audio player including a mass storage medium such as a flash memory has been introduced, a style of importing and viewing several thousands (or several tens of thousands) of musical pieces in the mass storage medium has been generally used. A mobile apparatus having a network function and including an audio player may access the Internet even outdoors so as to listen to or purchase music.

In this way, a large amount of musical pieces may be casually held and transferred casually outdoors. However, it is necessary to easily search for a desired musical piece without stress from an unfathomably large number of musical pieces.

That is, when a musical piece is selected, a user listens to the beginning of the musical piece, and by selecting the song title or artist, determines whether or not the user will listen to the musical piece. However, since the beginning of most musical pieces is accompaniment, it is difficult to determine whether it is a desired musical piece. If a large number of musical pieces is present, the user may encounter a musical piece they do not recognize, and the opportunity to listen to a desired musical piece at a desired time may be lost.

As a method for solving such a problem, there is a method of enhancing searchability by reproducing the "hook" part which is a climax part of a musical piece. Since the "hook" is the climax part of the musical piece, the hook makes a strong impression on the user. Thus, by detecting a hook with high accuracy and reproducing the hook when a musical piece is selected, it is possible to enhance the searchability of a musical piece. As in a music ranking TV program, sequentially reproducing the hooks becomes one music enjoyment method.

As a method of detecting a hook, a method of extracting a hook by calculating similarity by autocorrelation is proposed (see Japanese Patent No. 4243682).

As a method of detecting an audio change point and extracting a hook by focusing attention on an audio signal level, a method of detecting an audio change point from the maximum value of an evaluation function including a root mean square, and the like as a feature value and extracting a hook is proposed (see Japanese Patent No. 3886372).

A method of using an audio signal level as a feature value, a method of detecting an audio change point by distinguishing a threshold value of the amount of change or the level, and extracting a hook from a similar section of a time distribution or a combination of an interval of audio change points is proposed (see Japanese Unexamined Patent Application Publication No. 2008-262043).

SUMMARY

However, the method of Japanese Patent No. 4243682 is based on the presupposition that the "hook" has the highest frequency of appearance in the musical piece is highest, and is repeatedly reproduced. This method is valid based on the properties of music, but, depending on the musical piece, the most repeated part may not be the "hook". That is, there are musical pieces in which the most repeated part is melody A. In addition, the processing load for extracting a feature value or calculating similarity is large.

The methods of Japanese Patent No. 3886372 and Japanese Unexamined Patent Application Publication No. 2008-262043 are based on the property of music that the audio signal level of the "hook" is greater than that of the "Melody A" or "interlude", but the processing structure is simpler than the method of Japanese Patent No. 4243682, thereby increasing processing speed.

However, although a temporal audio signal level of an actual musical piece has intense highs and lows, and the tune or tempo (beats per minute; BPM) depends on the musical piece, Japanese Patent No. 3886372 and Japanese Unexamined Patent Application Publication No. 2008-262043 do not deal with these. The audio change points are excessively detected, or part with a suddenly large audio signal level is erroneously detected instead of the hook, such that the hook is prone to erroneous detection. If the granularity of the feature value calculation is set rough (if a long processing time length is set), the highs and lows of the temporal audio signal level are reduced, but the temporal resolution deteriorates. Thus, it is necessary to appropriately adjust the processing time length. In addition, it is necessary to consider treatment of a suddenly large audio signal.

It is desirable to accurately detect an audio change point based on an audio signal and extract a hook place at a high speed with high accuracy.

According to an embodiment of the present disclosure, there is provided an audio processing apparatus including: an audio signal acquisition unit configured to acquire the audio signal of a musical piece; a feature value extraction unit configured to extract a predetermined type of feature values from the audio signal acquired by the audio signal acquisition unit in time series; a change point detection unit configured to detect a change point in which the amount of change of the feature values extracted in time series by the feature value extraction unit is changed to be greater than a predetermined threshold value; a hook analysis unit configured to analyze a hook place of the audio signal based on the feature values extracted by the feature value extraction unit in block units with the change point detected by the change point detection unit as a boundary; and a hook information output unit configured to output the hook place analyzed by the hook analysis unit as hook information.

The type of feature value may include any one of a root mean square of a stereo sum signal, a root mean square of a stereo difference signal, a square sum of the amplitude of a stereo sum signal and a square sum of the amplitude of a stereo difference signal or a combination thereof.

The change point detection unit may include a smoothing unit configured to smooth the feature values of the time series; a change amount calculation unit configured to calculate the amount of change; a change point determination unit configured to determine whether or not the amount of change is the change point; a change point detection control unit configured to control a calculation place of the amount of change and record the position of the change point if the change point is detected; and a change point unification unit configured to unify a plurality of change points.

The change point detection unit may further include a normalization unit configured to normalize the feature values of the time series.

The change point detection unit may include a change point redetection unit configured to execute any one or both of a process of changing the predetermined threshold value so as to decrease the number of change points if the number of change points is greater than the predetermined threshold value by comparison of the number of change points and the predetermined threshold value and a process of smoothing the feature values of the time series again by the smoothing unit and determining whether or not the amount of change is the change point again.

The change point detection unit may include a change point redetection unit configured to change the predetermined threshold value so as to increase the number of change points and determine whether or not the amount of change is the change point again, if a period greater than a predetermined time and without the change point is present.

The smoothing unit may smooth the feature values of the time series by a moving average in a predetermined period.

The smoothing unit may smooth the feature values of the time series by the moving average in the predetermined period based on a tempo obtained in advance.

The change point detection unit may include a change point adjustment unit configured to unify a plurality of adjacent change points among the change points.

The change point detection unit may include a change point adjustment unit configured to unify two adjacent change points among the change points to a middle point.

The hook analysis unit may include a block division unit configured to perform division into blocks having the change points as boundaries, a hook block detection unit configured to obtain an average of the feature values in block units and detect a block, in which the average of the feature values is maximum, as a hook block, a hook block control unit configured to control the position of a block of an analysis object based on a restriction that a block continues to the hook block detected by the hook block detection unit, a hook block analysis unit configured to analyze the block of the analysis object, and a hook block determination unit configured to determine whether or not the block of the analysis object is a hook block based on the analysis result of the hook block analysis unit.

The hook block detection unit may set the average of the feature value obtained by widening a calculation range of the average of the feature values of the block unit to a predetermined length longer than the block as the average of the feature value, if the block, in which the average of the feature value is maximum, is less than a predetermined period.

The hook block analysis unit may analyze the block of the analysis object and obtains and sets the average of the feature value in the block of the analysis object as the analysis result, and the hook block determination unit may compute a predetermined threshold value based on a difference between the average of the feature value in the hook block detected by the hook block detection unit and the average of the feature value of the entire audio signal of the musical piece acquired by the audio signal acquisition unit, and determine whether the block of the analysis object is a hook block by comparison of the difference between the average of the feature value of the block of the analysis object and the average of the feature value of the entire audio signal of the musical piece and the threshold value.

The hook block analysis unit may include a hook block correction unit configured to correct the predetermined threshold value to be small, analyze the block of the analysis object again and determine whether or not the block of the analysis object is the hook block, if it is determined that the block of the analysis object is not the hook block by the hook block determination unit.

The hook block analysis unit may include a hook block correction unit configured to correct the number of samples of the block of the analysis object to be reduced, analyze the block of the analysis object again and determine whether or not the block of the analysis object is the hook block, if it is determined that the block of the analysis object is not the hook block by the hook block determination unit.

A hook information unification unit configured to unify hook information by plural predetermined types of feature values may be further included.

The audio signal acquisition unit may output an MDCT coefficient of the acquired audio signal of the musical piece.

According to another embodiment of the present disclosure, there is provided an audio processing method of an audio processing apparatus including an audio signal acquisition unit configured to acquire an audio signal of a musical piece, a feature value extraction unit configured to extract a predetermined type of feature value from the audio signal acquired by the audio signal acquisition unit in time series, a change point detection unit configured to detect a change point in which the amount of change of the feature value extracted in time series by the feature value extraction unit is changed to be greater than a predetermined threshold value, a hook analysis unit configured to analyze a hook place of the audio signal based on the feature value extracted by the feature value extraction unit in block units with the change point detected by the change point detection unit as a boundary, and a hook information output unit configured to output the hook place analyzed by the hook analysis unit as hook information, the audio processing method including: acquiring the audio signal of the musical piece, in the audio signal acquisition unit; extracting the predetermined type of feature value from the audio signal acquired by the acquiring of the audio signal in time series, in the feature value extraction unit; detecting a change point in which the amount of change of the feature value extracted in time series by the extracting of the feature value is changed to be greater than the predetermined threshold value, in the change point detection unit; analyzing a hook place of the audio signal based on the feature value extracted by the extracting of the feature value in block units with the change point detected by the detecting of the change point as a boundary, in the hook analysis unit; and outputting the hook place analyzed by the analyzing of the hook place as hook information, in the hook information output unit.

According to still another embodiment of the present disclosure, there is provided a program for executing, on a computer for controlling an audio processing method of an audio processing apparatus including an audio signal acquisition unit configured to acquire an audio signal of a musical piece, a feature value extraction unit configured to extract a predetermined type of feature value from the audio signal acquired by the audio signal acquisition unit in time series, a change point detection unit configured to detect a change point in which the amount of change of the feature value extracted in time series by the feature value extraction unit is changed to be greater than a predetermined threshold value, a hook analysis unit configured to analyze a hook place of the audio signal based on the feature value extracted by the feature value extraction unit in block units with the change point detected by the change point detection unit as a boundary, and a hook information output unit configured to output the hook place analyzed by the hook analysis unit as hook information, a process including: acquiring the audio signal of the musical piece, in the audio signal acquisition unit; extracting the predetermined type of feature value from the audio signal acquired by the acquiring of the audio signal in time series, in the feature value extraction unit; detecting a change point in which the amount of change of the feature value extracted in time series by the extracting of the feature value is changed to be greater than the predetermined threshold value, in the change point detection unit; analyzing a hook place of the audio signal based on the feature value extracted by the extracting of the feature value in block units with the change point detected by the detecting of the change point as a boundary, in the hook analysis unit; and outputting the hook place analyzed by the analyzing of the hook place as hook information, in the hook information output unit.

In the embodiments of the present disclosure, an audio signal of a musical piece is acquired, a predetermined type of feature value is extracted from the acquired audio signal in time series, a change point in which the amount of change of the feature value extracted in time series is changed to be greater than a predetermined threshold value is detected, a hook place of the audio signal is analyzed based on the feature value extracted in block units with the detected change point as a boundary, and the analyzed hook place is output as hook information.

The audio processing apparatus of the embodiment of the present disclosure may be an independent apparatus or a block performing audio processing.

According to the embodiments of the present disclosure, it is possible to extract a hook from an audio signal including an input musical piece with high accuracy.

DETAILED DESCRIPTION OF EMBODIMENTS

Configuration Example of Music Analysis Device

Figure 1:
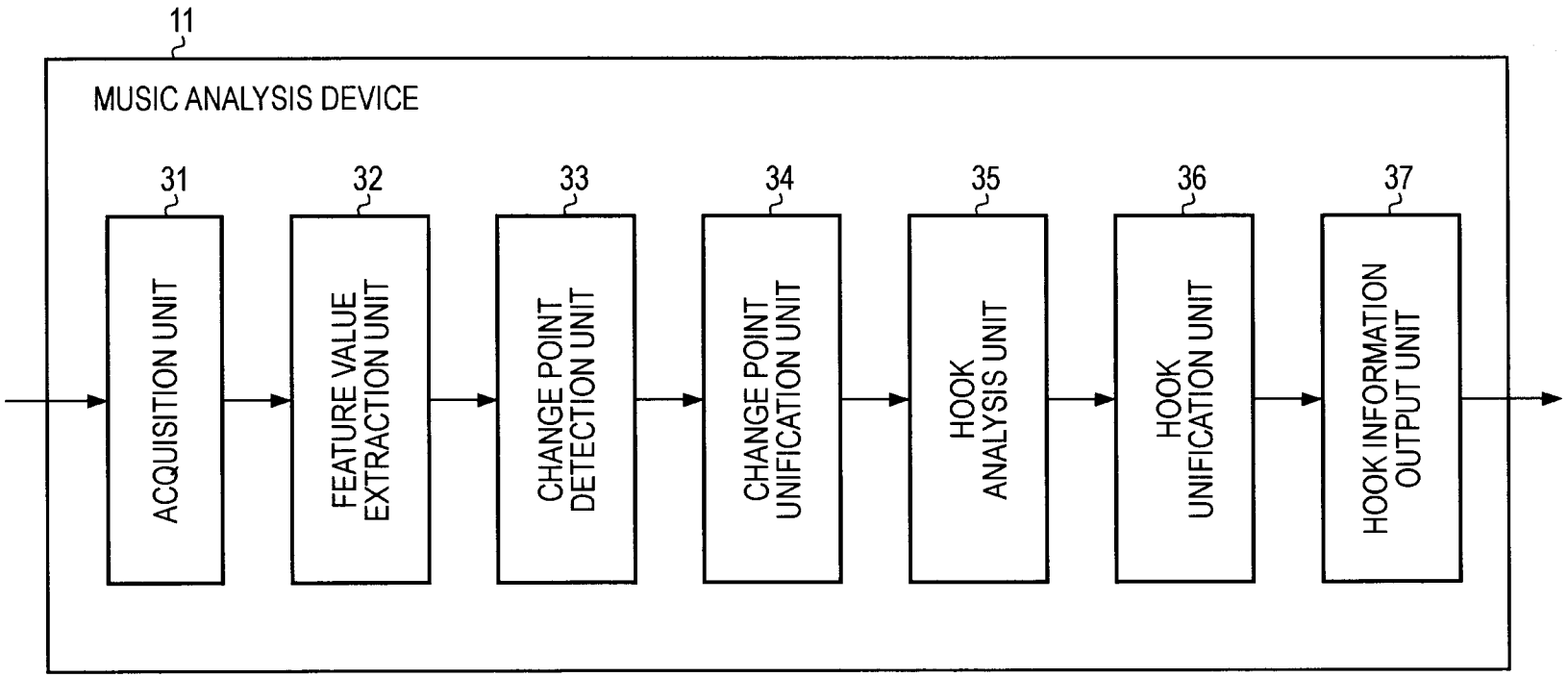
FIG. 1 is a block diagram showing a configuration example of a music analysis device according to an embodiment of the present disclosure.

FIG. 1 shows a configuration example of hardware of a music analysis device according to an embodiment of the present disclosure. The music analysis device 11 of FIG. 1 receives and acquires an input of an audio signal including a musical piece, extracts and analyzes a feature value, extracts a so-called hook from the musical piece, and outputs the hook as hook information. Here, the hook is a climax part of a musical piece or a part having a strong impression on a listener and is a part for which there is a high possibility that a listener may perceive to which music the part belongs when the listener hears that part of the musical piece although the listener does not remember a song title, an artist, and the like.

The music analysis device 11 includes an acquisition unit 31, a feature value extraction unit 32, a change point detection unit 33, a change point unification unit 34, a hook analysis unit 35, a hook unification unit 36, and a hook information output unit 37.

The acquisition unit 31 acquires an audio signal including an input musical piece (audio content). The acquisition unit 31 receives and supplies an audio signal of a Pulse Code Modulation (PCM) format to the feature value extraction unit 32. The acquisition unit 31 receives an audio signal of a format different from the PCM format and converts the audio signal into a PCM format as necessary, because the acquisition unit has a function for converting the audio signal into the PCM format. The format different from the PCM format of the audio signal may be, for example, a compression format such as Moving Picture Experts Group Audio Layer-3 (MP3). In this case, the acquisition unit 31 may perform a decoding process in correspondence with a compression format as necessary and supply a modified discrete cosine transform (MDCT) coefficient or the like which is the format of the audio signal in a decoding process to the feature value extraction unit 32.

Since the audio signal including musical pieces is generally in a compression format such as MP3 in order to efficiently deal with a memory, it is preferable that a processing time length (frame length) be fixed due to restriction in the size of a buffer for storing the audio signal. Here, although the frame length is fixed (1024 [sample/channel]), the frame length may be freely set and is not limited thereto. Although the sampling frequency of the audio signal including the musical pieces or the number of channels is not limited, the sampling frequency is generally 44100 [Hz] and the number of channels is set to 2 [channel] in an audio compact disc (CD) as a representative example.

The feature value extraction unit 32 extracts a predetermined type of feature value from the audio signal in the PCM format supplied from the acquisition unit 31 in time series and supplies a time-series feature value to the change point detection unit 33 as a time-series feature value. The feature value described herein includes, for example, zero cross rate, spectrum centroid, spectrum change amount, mel-frequency cepstrum coefficient, and the like. Zero cross rate refers to a ratio of the number of times of change in positive/negative sign in a time axis signal as a feature value which is generally used in music analysis or voice recognition. Spectrum centroid refers to a central position of a frequency spectrum as a feature value. Spectrum change amount refers to the amount of change of a frequency spectrum as a feature value. The mel-frequency cepstrum coefficient refers to a coefficient obtained by compressing a frequency spectrum using a mel scale and performing Fourier transform with respect to a mel-frequency spectrum which is its log. The feature value extraction unit 32 may extract any one of the above-described feature values in time series as a predetermined feature value or extract a combination of a plurality of feature values in time series as a predetermined feature value. In the following description, for convenience of description, the feature value extraction unit 32 extracts an audio signal level in time series as a predetermined feature value. The type of the feature value may be arbitrary and is not limited to the above-described feature value.

Now, the audio signal level will be described. In general, the hook has a music property that the audio signal level is greater than that of an initial melody part which is called Melody A, an interlude or the like different from the hook. Accordingly, a stereo sum signal M(n) expressed by the following Equation 1 is regarded to be used as a feature value. The hook is a climax part of a musical piece. In addition, in the hook, since the number of sounds (instrument sounds, back chorus, or the like) is large and a sound is positioned in a wide range as compared to the Melody A or the interlude, a stereo difference signal S(n) expressed by the following Equation 2 is also regarded to be used as a feature value.

$$M(n)=(L(n)+R(n))/2 \quad \text{Equation 1}$$

$$S(n)=(L(n)-R(n))/2 \quad \text{Equation 2}$$

where, L(n) denotes an audio signal level of a left channel, R(n) denotes an audio signal level of a right channel, and n denotes a sample number.

As a method of calculating the audio signal level with respect to each of the stereo sum signal M(n) and the stereo difference signal S(n), there is a root mean square (RMS) of the amplitude or a square sum. Here, an example of using a root mean square (RMS) as a feature value will be described. The root mean square RMS(N) is expressed by the following Equation 3.

$$\mathrm{RMS}(N)=\sqrt{\frac{\sum_{n=0}^{n=K-1} x(n)^2}{K}} \quad \text{Equation 3}$$

where, x(n) denotes an amplitude value of a signal at a time n in a frame of a stereo sum signal M(n) or a stereo difference signal S(n), K denotes the number of samples of a frame, and N denotes a frame number.

Next, an example in which the feature value extraction unit 32 outputs a root mean square value (RMSM) of a stereo sum signal and a root mean square value (RMSL) of a stereo difference signal from the audio signal of the PCM format including the input musical piece in frame units as a time-series feature value will be described.

The change point detection unit 33 detects a change point in which a difference in absolute value between feature values continuously at a predetermined interval based on the time-series feature value supplied from the feature value extraction unit 32 is increased and supplies information about the detected change point to the change point unification unit 34. If plural types of feature values are used, the change point detection unit 33 detects the change point of each of the types of the feature values and supplies information about the change point of each of the types of the feature values to the change point unification unit 34. The detailed configuration of the change point detection unit 33 will be described with reference to FIG. 2.

The change point unification unit 34 unifies change points having close time intervals based on the information about all types of change points supplied from the change point detection unit 33 and supplies change point unification information to the hook analysis unit 35. The change point unification unit 34 unifies information about the change points of plural types of feature points to one change point unification information.

The hook analysis unit 35 blocks information about the time-series feature value of each type based on the change point unification information supplied from the change point unification unit 34 and detects a hook based on a block in which an average level per block of the feature value is a maximum. The hook analysis unit 35 obtains a start point and an end point of the hook by comparison between the level of a sequentially front or rear of a next block from a block which becomes a reference of the hook detected in each type of the feature value and an average level of the entire musical piece and supplies the start point and the end point of the hook to the hook unification unit 36. The detailed configuration of the hook analysis unit 35 will be described below with reference to FIG. 3.

The hook unification unit 36 unifies position information of the start point and the end point of the hook obtained in each type of the feature value, generates hook information, and supplies the hook information to the hook information output unit 37. The hook information output unit 37 outputs the supplied hook information as information indicating the hook of the audio signal including the acquired musical piece.

Configuration Example of Change Point Detection Unit

Figure 2:
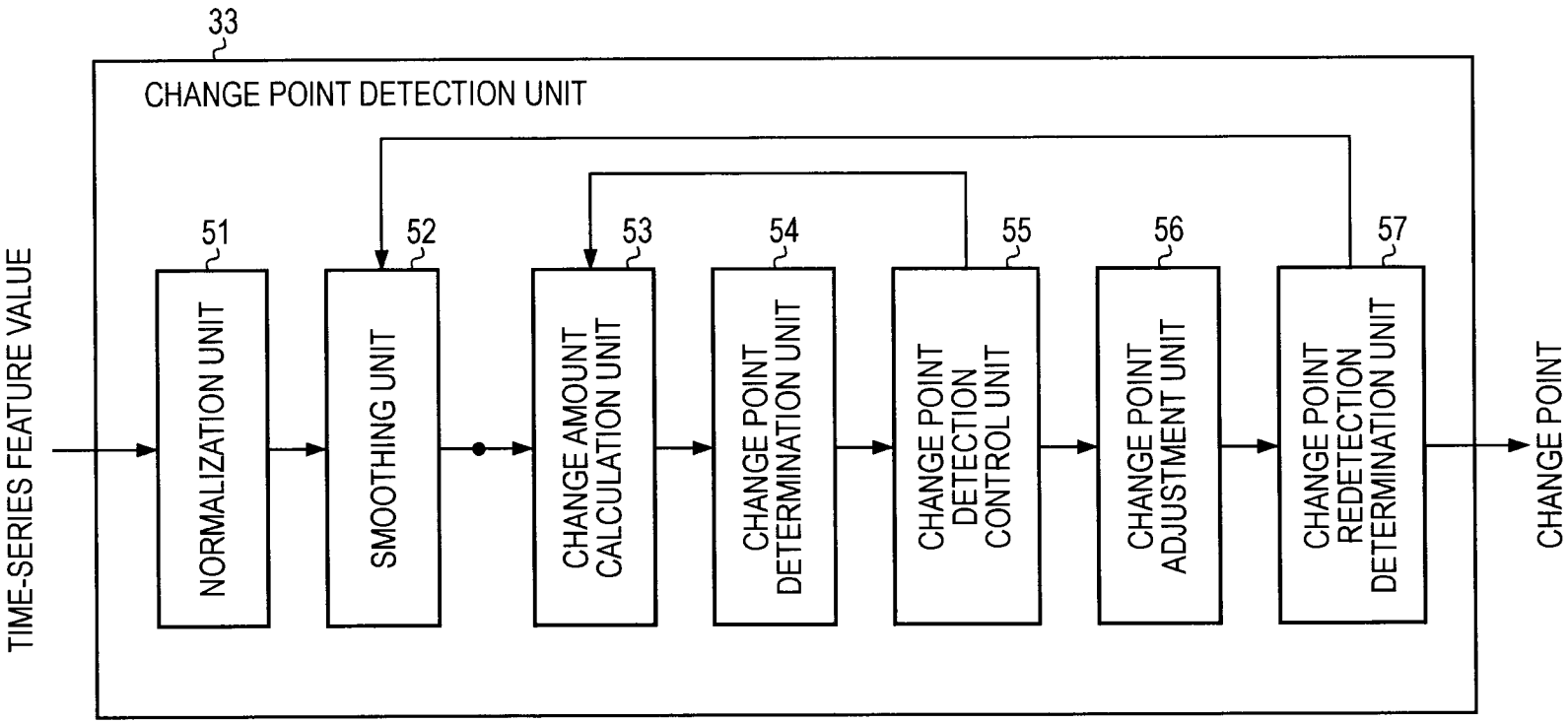
FIG. 2 is a diagram showing a configuration example of a change point detection unit of FIG. 1.

Next, the detailed configuration of the change point detection unit 33 will be described with reference to FIG. 2.

The change point detection unit 33 includes a normalization unit 51, a smoothing unit 52, a change amount calculation unit 53, a change point determination unit 54, a change point detection control unit 55, a change point adjustment unit 56, and a change point redetection determination unit 57.

The normalization unit 51 removes each time-series feature value using a maximum value and performs normalization with respect to the time-series feature value supplied from the feature value extraction unit 32 as shown in the following Equation 4 and supplies a time-series normalization feature value to the smoothing unit 52.

$$g(N)=f(N)/\mathrm{fmax} \quad \text{Equation 4}$$

where, g(N) denotes a time-series normalization feature value of an N-th frame, f(N) denotes a time-series feature value of an N-th frame, and a fmax denotes a maximum value of time-series feature values.

The smoothing unit 52 smoothes the normalized time-series feature values by obtaining a moving average shown in the following Equation 5 and supplies the smoothed time-series feature value to the change amount calculation unit 53.

$$MA(N)=\frac{\sum_{k=0}^{L-1} g(k+N)}{L} \quad \text{Eqauation 5}$$

where, MA(N) denotes a moving average value of the time-series normalization feature value of an N-th frame, g(k+N) denotes a time-series normalization feature value of a (k+N)-th frame, L denotes a length (the number of samples) which becomes an object of a moving average, and N denotes a frame number.

That is, if a frame length becomes short, time resolution of the time-series normalization feature value is increased but a waveform thereof extremely undulates. Thus, it may be difficult to compare the time-series normalization feature value with a threshold value. Therefore, by using a moving average value in a range of the number L of samples, the time-series normalization feature value is smoothed. The number L of samples may be changed by the tempo of the musical piece configuring the input audio signal.

The change amount calculation unit 53 obtains the amount D of change of the smoothed time-series normalization feature value as a difference in absolute value between neighboring frames as shown in the following Equation 6 and sequentially supplies the amount D of change to the change point determination unit 54. The change point determination unit 54 compares the amount D of change with a predetermined threshold value, recognizes a change point when the amount of change is greater than the threshold value, and supplies a comparison result to the change point detection control unit 55.

$$D=\mathrm{ABS}(MA(N+J)-MA(N)) \quad \text{Equation 6}$$

where, D denotes the amount of change, ABS( ) denotes an absolute value, MA(N+J) and MA(N) respectively denote moving average values of time-series normalization feature values of frame numbers (N+J) and N, and J denotes the number of frames.

The change point determination unit 54 compares the amount of change supplied from the change amount calculation unit 53 with a predetermined threshold value, and supplies to the change point detection control unit 55 a comparison result which is regarded as a change point if the amount of change is greater than the predetermined threshold value and is regarded as a non-change point if the amount of change is equal to or less than the predetermined threshold value.

The change point detection control unit 55 supplies the comparison result indicating the change point or the non-change point supplied from the change point determination unit 54 to the change point adjustment unit 56. The change point detection control unit 55 controls the change amount calculation unit 53 and sequentially calculates the amount of change from a frame separated from a frame position which is the change point by a predetermined distance, if the comparison result is the change point. That is, the change point is computed in order of sequential frame number. However, if the change point is detected, the calculation position of the amount of change is significantly changed so as to prevent the repeated detection of a change point in the vicinity of the change point, thereby suppressing inefficient detection of a change point.

The change point adjustment unit 56 unifies change points obtained by an interval in which a distance between frames is less than a predetermined distance, based on information about the change point which is the comparison result supplied from the change point detection control unit 55, and adjusts the interval between the change points, and supplies the adjusted interval to the change point redetection determination unit 57. The change point adjustment unit 56 unifies, for example, two change points, in which the distance between the frames is less than the predetermined distance, to a middle position. A unification method is not limited thereto and other methods may be used. The distance between the frames during unification may be set according to the tempo of the musical piece which is the audio signal.

The change point redetection determination unit 57 determines whether or not a total number of change points is greater than a predetermined threshold value and whether the interval between frames without change points is less than a predetermined threshold value, based on information about the adjusted change point, and determines whether or not the change point is redetected according to the determination result. For example, if the total number of change points is greater than the predetermined threshold value, the amount of information about the change point is large and undulates. Therefore, the change point redetection determination unit 57 controls the smoothing unit 52 so as to increase the number L of samples of a moving average. Since the change point may be reduced, the redetection determination unit 57 may control the change amount calculation unit 53 so as to increase the predetermined threshold value, instead of controlling the smoothing unit 52 so as to increase the number L of samples of the moving average. For example, if the interval between the frames without change points is greater than the predetermined threshold value, since the interval between the frames without information about change points is too large, the change point redetection determination unit 57 controls the change amount calculation unit 53 to decrease the predetermined threshold value, thereby easily controlling the detection of the change point. The change point redetection determination unit 57 outputs the supplied information about the change point if the total number of change points is less than the predetermined threshold value or if the interval between the frames without the change points is less than the predetermined threshold value, based on the information about the adjusted change point.

Configuration Example of Hook Analysis Unit

Figure 3:
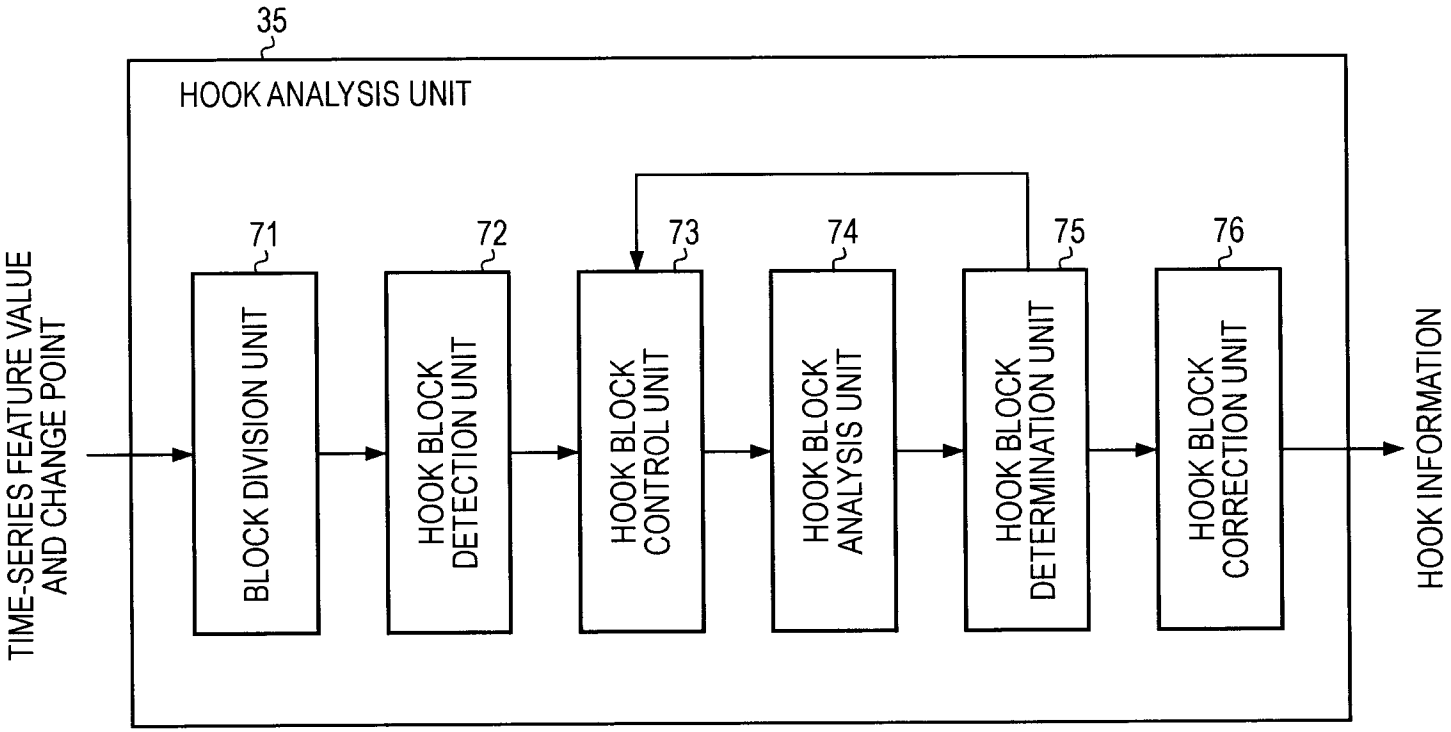
FIG. 3 is a diagram showing a configuration example of a hook analysis unit of FIG. 1.

Next, the detailed configuration of the hook analysis unit 35 will be described with reference to FIG. 3.

A block division unit 71 divides the time-series normalization feature value at an interval of a change point into block units for each type based on the information about a change point of change point unification information and supplies blocks to a hook block detection unit 72.

The hook block detection unit 72 obtains an average value of the time-series normalization feature value as a block average value for each type in block units supplied from the block division unit 71, detects a block having a maximum value as a hook block, and supplies the block to a hook block control unit 73.

A hook block control unit 73 supplies a front block and a rear block in a time direction of the hook block to a hook block analysis unit 74 as a block which becomes a candidate for a start position and an end position of the hook block.

The hook block analysis unit 74 computes a block average value of the time-series normalization feature value of the block which becomes the candidate for the start position and the end position of the hook block and supplies the block average value to a hook block determination unit 75.

The hook block determination unit 75 compares a difference between the block average value of the time-series normalization feature value of the block which becomes the candidate for the start position and the end position of the hook block and an average of the feature value in the entire audio signal of the musical piece with a threshold value Vth set by the following Equation 7.

$$Vth=(BMA\max-MAav)\times\alpha \quad \text{Equation 7}$$

where, Vth denotes the threshold value, BMAmax denotes the block average value of the time-series normalization feature value in a block in which the average of time-series normalization feature values becomes a maximum, MAav denotes an average value of the entire musical piece of the time-series normalization feature value, and a denotes an adjustment coefficient. When the average value MAav of the entire musical piece of the time-series normalization feature value is calculated, comparison with a silent place is performed and a point having a very low audio signal level is preferably excluded from a calculation object.

The hook block determination unit 75 updates the start position and the end position using a candidate block as a hook block if the difference between the block average value and the average of the feature value of the entire audio signal of the musical piece is greater than the threshold value Vth. The hook block determination unit 75 controls the hook block control unit 73 and instructs repeated performing of the same process with respect to the front and rear blocks. This process is repeated and, if the difference between the block average value and the average of the feature value of the entire audio signal of the musical piece is less than the threshold value Vth, the candidate block is supplied to the hook block correction unit 76.

The hook block correction unit 76 adjusts an adjustment coefficient $\alpha$ with respect to a candidate block of the hook block and decreases the threshold value Vth. Alternatively, the same process is repeated again by the block average value excluding the time-series feature value of the vicinity of the leading block and the vicinity of the end block of the start point and the end point. By this process, the hook block correction unit 76 determines whether or not a block which becomes an end of the hook block is the block of the start position and the end position again. If the difference between the block average value and the average of the feature value of the entire audio signal of the musical piece is greater than the threshold value, the hook block correction unit 76 updates and outputs the start position and the end position using the candidate block as the hook block. If the difference between the block average value and the average of the feature value of the entire audio signal of the musical piece is less than the threshold value, the hook block correction unit 76 outputs the start position and the end position of the hook block in the related art.

Music Analysis Process

Next, a music analysis process will be described with reference to the flowchart of FIG. 4.

In step S1, the acquisition unit 31 acquires an audio signal including an input musical piece, decodes an audio signal of a compression format as necessary, converts the audio signal into an audio signal of a PCM format, and supplies the audio signal of the PCM format to the feature value extraction unit 32.

In step S2, the feature value extraction unit 32 extracts a predetermined type of feature value from the audio signal configuring a musical piece in time series as a time-series feature value. Here, although the case where the type of the time-series feature value extracted by the feature value extraction unit 32 is a stereo sum signal and a stereo difference signal, both of which are the above-described audio signal levels, is described, other types of time-series feature values may be used.

In step S3, the change point detection unit 33 executes a change point detection process, detects a change point for each type of the time-series feature value, and supplies a change point detection result to the change point unification unit 34.

Change Point Detection Process

Figure 5:
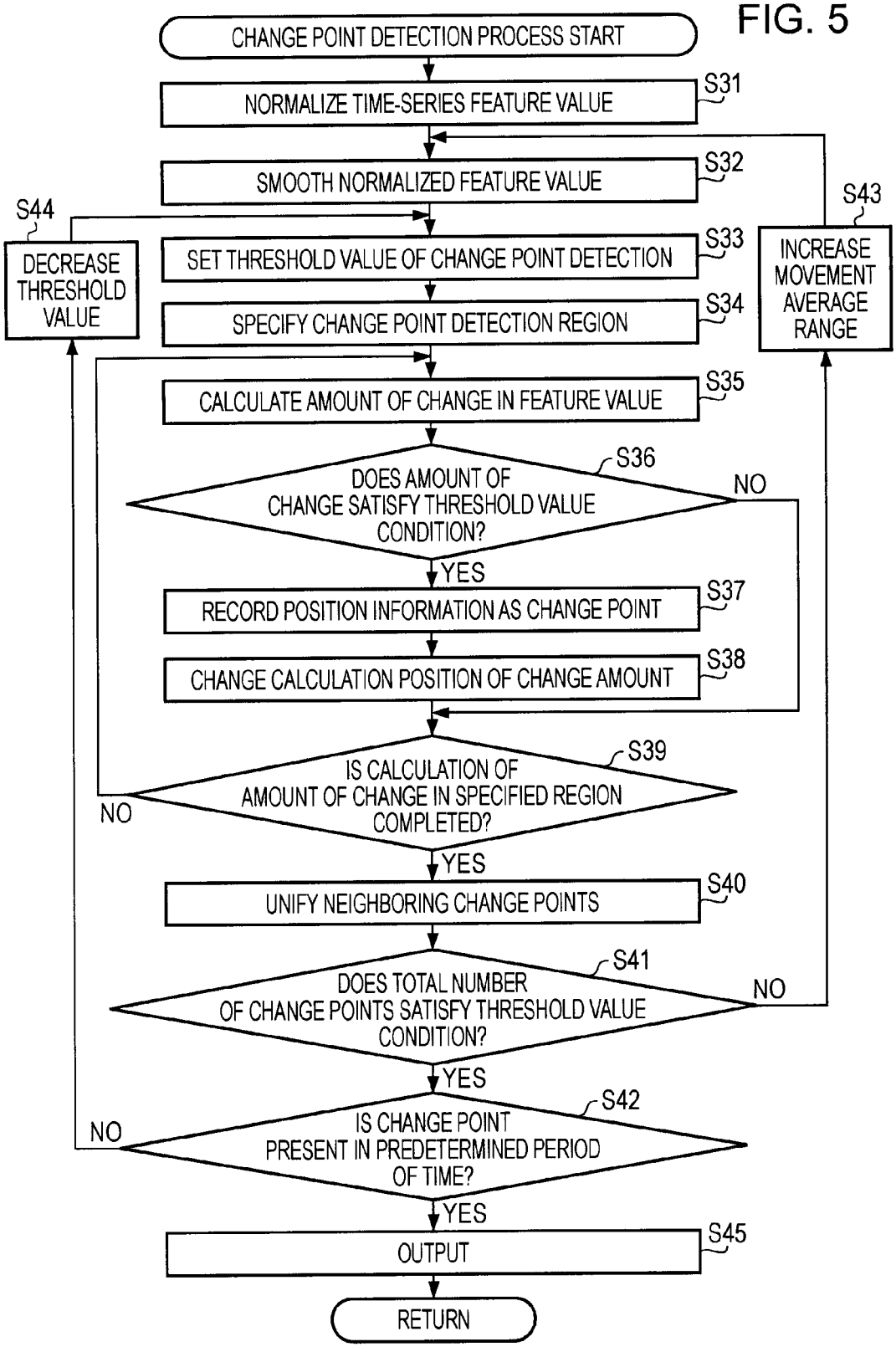
FIG. 5 is a flowchart illustrating a change point detection process.

A change point detection process will be described with reference to the flowchart of FIG. 5.

In step S31, the normalization unit 51 removes all time-series feature values using a maximum value of the time-series feature values for each type by computing the above-described Equation 4, performs normalization, and supplies the time-series normalization feature value to the smoothing unit 52.

In step S32, the smoothing unit 52 performs smoothing by obtaining and replacing a moving average by the number L of samples with respect to all the time-series feature values for each type and supplies the smoothed time-series feature values to the change amount calculation unit 53. The number L of samples becomes a default value in an initial process, but becomes a value set based on the total number of change points by the change point redetection determination unit 57 by the process described below in the second process or thereafter.

Figure 6:
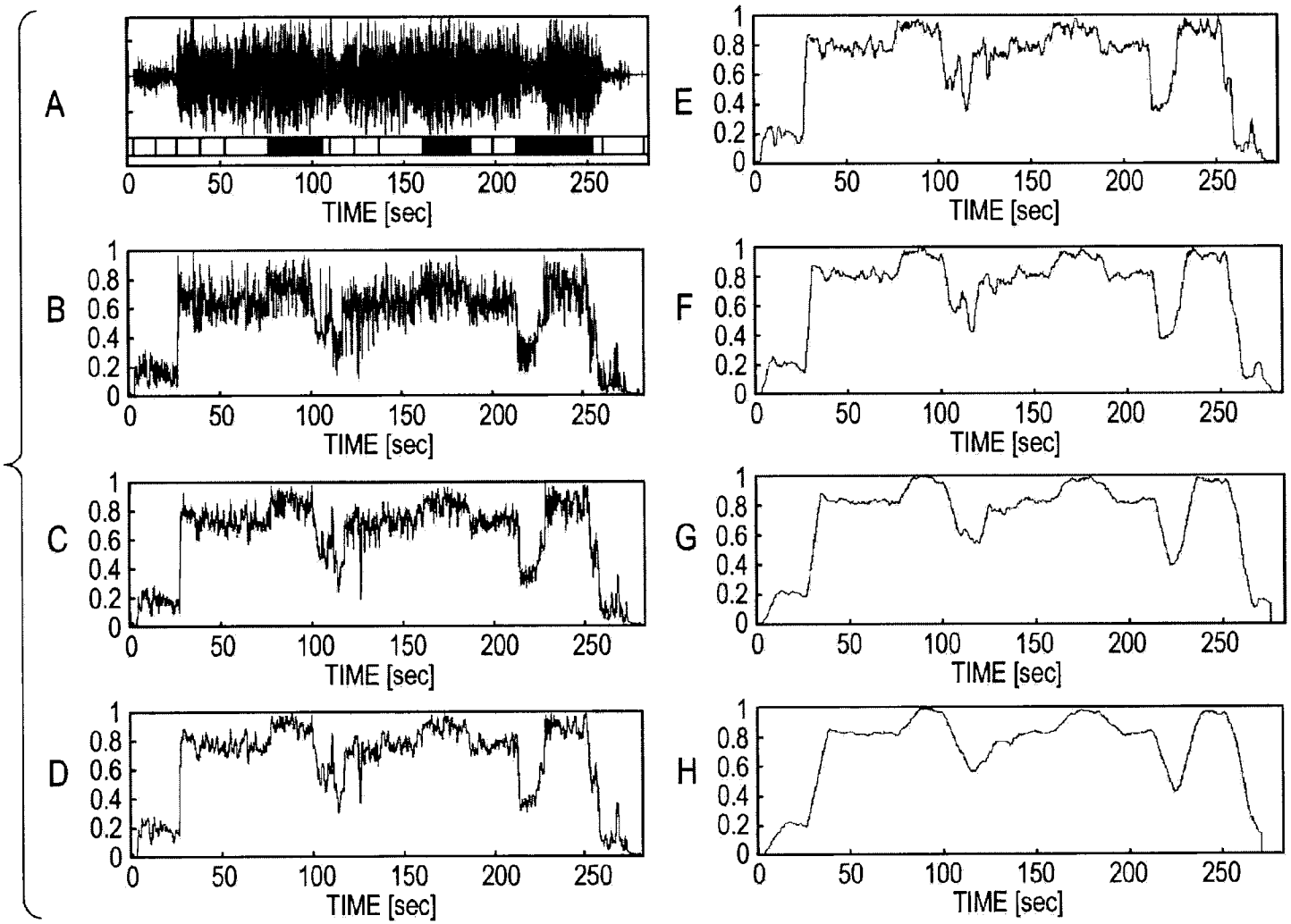
FIG. 6 is a diagram illustrating the change point detection process.

In the smoothing of each time-series feature value, for example, when the time-series normalization feature value extracted from the audio signal shown in a waveform A of FIG. 6 is shown in a waveform B of FIG. 6, the time-series normalization feature value extremely undulates and an adverse effect occurs when a significant change point such as a boundary between the Melody A and the hook is detected. In a black/white band part of the lower part of the waveform A of FIG. 6, a black part is a hook and a white part is a part other than the hook.

In contrast, as shown in waveforms C to H of FIG. 6, when smoothing is performed, the waveform does not undulate and a relationship between the boundary between the Melody A and the hook and the change point becomes clarified. In addition, the waveforms C to H are obtained when smoothing is performed by replacing the time-series normalization feature value which becomes a length of a moving average object of each of 0.5 seconds, 1.0 seconds, 2.0 seconds, 4.0 seconds, 8.0 seconds and 12.0 seconds as a moving average.

However, as shown in a waveform H of FIG. 6, if the length of the moving average object is dramatically increased, time resolution deteriorates. Thus, it is necessary to appropriately adjust the length of the moving average object. In this case, the length of the moving average object shown in a waveform E is set to the number L of samples corresponding to about 2 [sec]. The length of the moving average object is preferably set according to a tempo (BPM, beats per minute). For example, the length of the moving average object may be set to a length of one bar based on the tempo.

In step S33, the change point redetection determination unit 57 sets the threshold value of the amount of change which becomes a change point. That is, the change point redetection determination unit 57 becomes a default value in an initial process, but is set by the number of change points present within a predetermined time in the second process or thereafter.

In step S34, the change amount calculation unit 53 sets a region in which a change point will be detected. The region in which the change point will be detected is predetermined, but becomes generally the entire audio signal including the acquired musical piece in an initial process.

In step S35, the change amount calculation unit 53 calculates a difference in absolute value between the unprocessed smallest frame number N of the input time-series normalization feature values and the value of the time-series normalization feature value of a frame number (N+J) obtained by adding a predetermined number J of samples to the frame number N as the amount D of change and supplies the difference in absolute value to the change point determination unit 54.

In step S36, the change point determination unit 54 compares the supplied amount D of change with the threshold value and determines whether or not the amount of change is greater than the threshold value. For example, if it is determined that the amount of change is greater than the threshold value and the threshold value condition is satisfied in step S36, the process progresses to step S37.

In step S37, the change point determination unit 54 supplies information indicating that a timing when the time-series normalization feature value of the frame N in which the supplied amount of change is obtained is a change point position to the change point detection control unit 55, along with the determination result. The change point detection control unit 55 supplies and stores the information indicating that a timing when the time-series normalization feature value of the frame N in which the supplied amount of change is obtained is the change point position to and in the change point adjustment unit 56.

In step S38, the change point determination unit 54 adds a predetermined value T to the frame number N of the currently compared amount of change, completes the process of comparing the amount of change with the threshold value up to the frame number (N+T), and controls the change point detection control unit 55 to execute the subsequent process.

Figure 7:
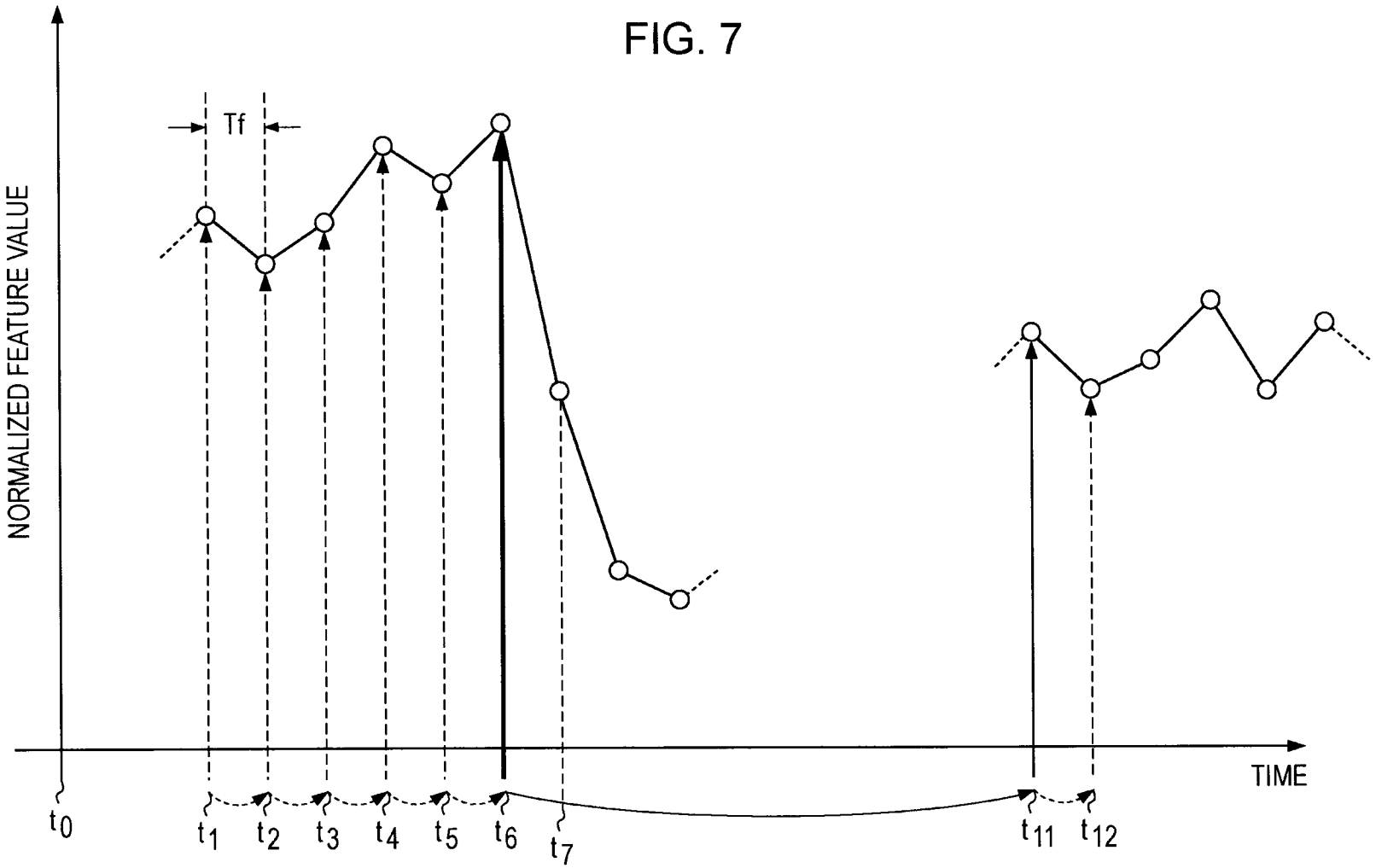
FIG. 7 is a diagram illustrating the change point detection process.

That is, as shown in FIG. 7, if the amount of change corresponding to a time t6 is greater than the predetermined threshold value and the threshold value condition is satisfied, the frame number is changed to a frame number N (t11) corresponding to a time t11 obtained by adding a predetermined value T to the processed frame number N (t6) and the amount of change up to the change point corresponding to this frame number is calculated. This is because, when a change point is detected, the calculation position of the amount of change is significantly changed so as to prevent repeated detection of the change point in the vicinity of the change point to suppress detection of an inefficient change point. The newly updated calculation position of the amount of change is separated from an original calculation position by about one bar, for example, similarly to the case of calculating the amount of change. In FIG. 7, a horizontal axis is a time and a vertical axis is a value of a time-series normalization feature value at timing corresponding to each time. Each of times t1 to t7 and a period Tf between t11 and t12 is a frame length corresponding to the above-described number K of samples.

In step S39, the change point determination unit 54 determines whether or not the calculation of the amounts of change of all frame numbers is completed in a specified region. That is, it is determined whether the position corresponding to the frame number, which is the amount of change of which is next calculated, exceeds the specified region. If it is determined that the calculation of the amounts of change of all frame numbers is not completed in the specific region in step S39, the process returns to step S35. In contrast, if the amount of change is less than the threshold value and the threshold value condition is not satisfied in step S36, the process of steps S37 and S38 is skipped. That is, the process of steps S35 to S39 is repeated until it is determined that all amounts of change are obtained.

If it is determined that all amounts of change are obtained in the specified region in step S39, the process progresses to step S40.

In step S40, the change point adjustment unit 56 unifies change points located in the vicinity of the detected change point and supplies information about the unified change point to the change point redetection determination unit 57.

Figure 8:
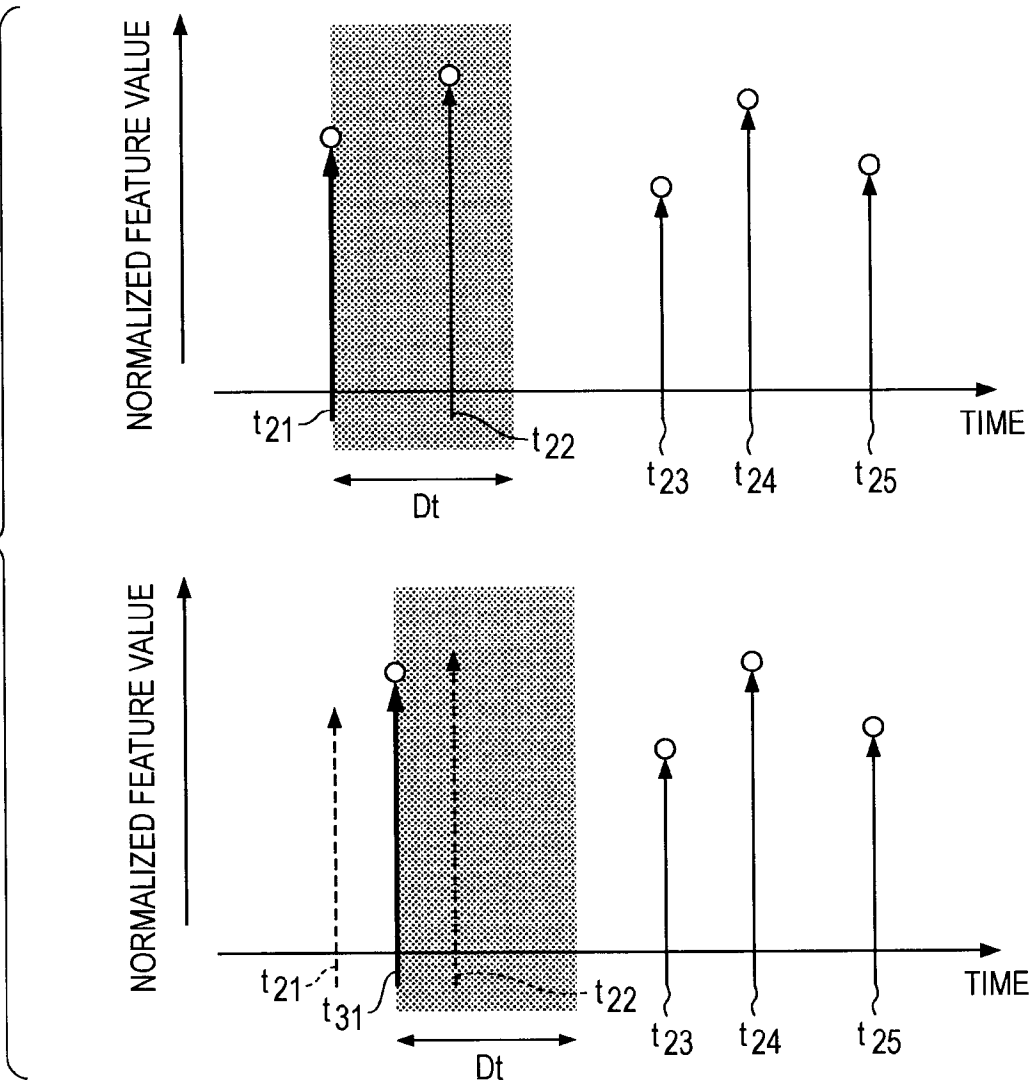
FIG. 8 is a diagram illustrating unification of change points.

That is, the change point adjustment unit 56 unifies the change points of timings corresponding to times t21 and t22 included in a predetermined unification range Dt as shown in the upper side of FIG. 8 to a time t31 which is a middle point between the times t21 and t22 as shown in the lower side of FIG. 8. In unification, the change points may be unified to timing which is not a middle point between two timings. The unification range Dt may be changed according to tempo.

In step S41, the change point redetection determination unit 57 determines whether or not the threshold value condition that the number of change points in the entire region in which the change point is detected is less than the predetermined threshold value is satisfied, based on the information about the timing of the supplied change point. For example, if it is determined that the threshold value condition that the number of change points in the entire region in which the change point is detected is less than the predetermined threshold value is not satisfied in step S41, the process progresses to step S43.

Figure 9:
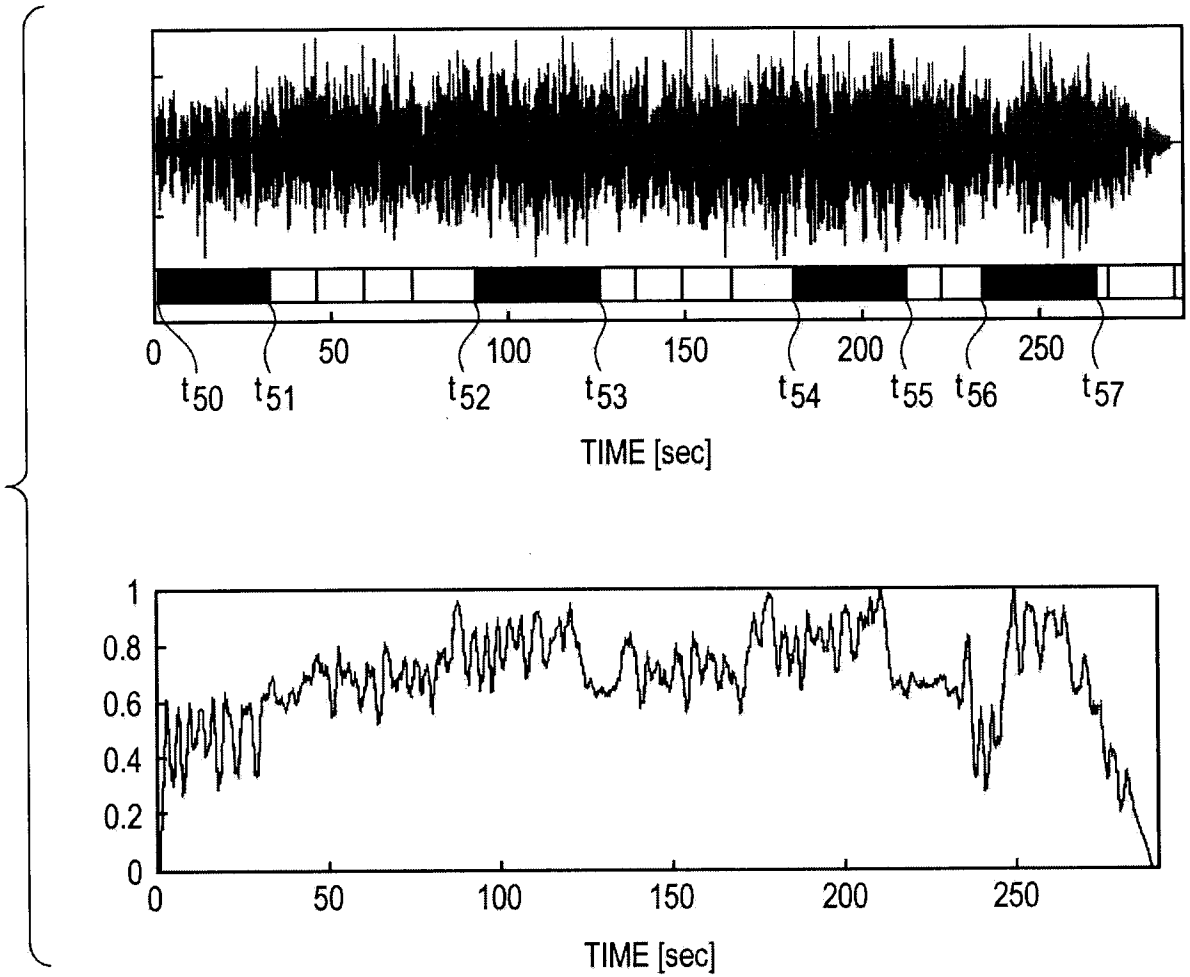
FIG. 9 is a diagram showing a waveform example in the case where smoothing is insufficient.

That is, in the case of the waveform of the audio signal shown in the upper side of FIG. 9, the time-series normalization feature value becomes a waveform shown in the lower side of FIG. 9 even when being smoothed at an interval of 2.0 seconds. That is, the waveform of the lower side of FIG. 9 extremely undulates and is less smoothed as compared to the waveform E of FIG. 6. Thus, the number of detected change points may become greater than the predetermined threshold value. Accordingly, the change points may be excessively detected so as to lead to deterioration in hook detection performance. In the case of a musical piece with low tempo (BPM) or in the case where the number of instruments is small, such as in the case of a musical piece with only piano accompaniment, undulation of the audio signal level tends to become severe. In the upper side of FIG. 9, a band part including a white part and a black part denotes a hook, a black part denotes a hook and a white part denotes a non-hook.

In step S43, the change point redetection determination unit 57 controls the smoothing unit 52 to increase the range of the moving average object upon smoothing and the process returns to step S32. As a result, the change point is detected again in a state in which the range of the moving average object is increased. Since a total time of a musical piece differs according to musical pieces, the threshold value of the number of change points is preferably the number of change points per unit time (for example, the number of change points per minute). Since the number of change points may be reduced, instead of increasing the range of the moving average range, the threshold value of the change point determination unit 54 may be reset larger so as to become a state in which the change point is hardly detected and the change point may be detected again.

Meanwhile, if it is determined that the threshold value condition that the number of change points in the entire region in which the change point is detected is less than the predetermined threshold value is satisfied in step S41, the process progresses to step S42.

In step S42, the change point redetection determination unit 57 determines whether a region without a change point is present in a predetermined time in step S42. This predetermined time may be changed according to tempo. If the region without the change point is present in the predetermined time, the process progresses to step S44.

In step S44, the change point redetection determination unit 57 controls the change point determination unit 54 so as to set a threshold value smaller by a predetermined value in order to easily detect the change point and sets a change point detection region to a corresponding region, and the process returns to step S33.

That is, since it is necessary to obtain a change point with respect to the region without the change point, the threshold value of the change point determination unit 54 is set to be as low as possible so as to become a state in which the change point is easily obtained, and the process is repeated again.

If it is determined that the region without the change point is not present in the predetermined time in step S42, the process progresses to step S45.

In step S45, the change point redetection determination unit 57 outputs information about the obtained change point. In addition, in the case of dealing with plural types of time-series feature values, the information about the change point of each type is generated and output.

By the above process, the timing when the amount of change of the time-series normalization feature value is greater than the threshold value is obtained as a change point and such time-series information is output as change point information. In the case of dealing with plural types of time-series feature value, change point information of each type is generated and the change point information is output.

Figure 4:
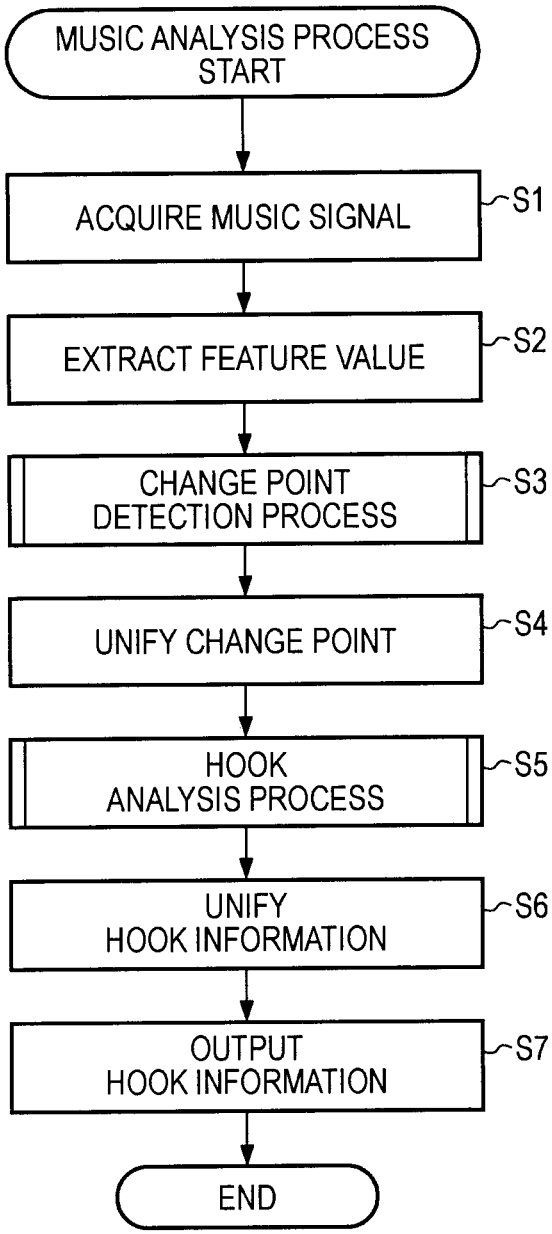
FIG. 4 is a flowchart illustrating a music analysis process.

Here, the description returns to the flowchart of FIG. 4.

When the change point information is generated by the change point detection point 33 and is supplied to the change point unification unit 34 by executing the change point detection process in step S3, the change point unification unit 34 unifies such change point information in step S4. That is, the change point information of each of the plural types is supplied, but a change point of a musical piece is finally necessary. Although plural types of change point information are present, the change points may show a similar trend. Thus, adjacent changes are sequentially unified regardless of type. The unification method is equal to the process described with reference to FIG. 8 and thus a description thereof will be omitted.

In step S5, the hook analysis unit 35 executes the hook analysis process, obtains the leading position and the end position of the hook block for each type of the time-series normalization feature value, and supplies the leading position and the end position to the hook unification unit 36.

Hook Analysis Process

Figure 10:
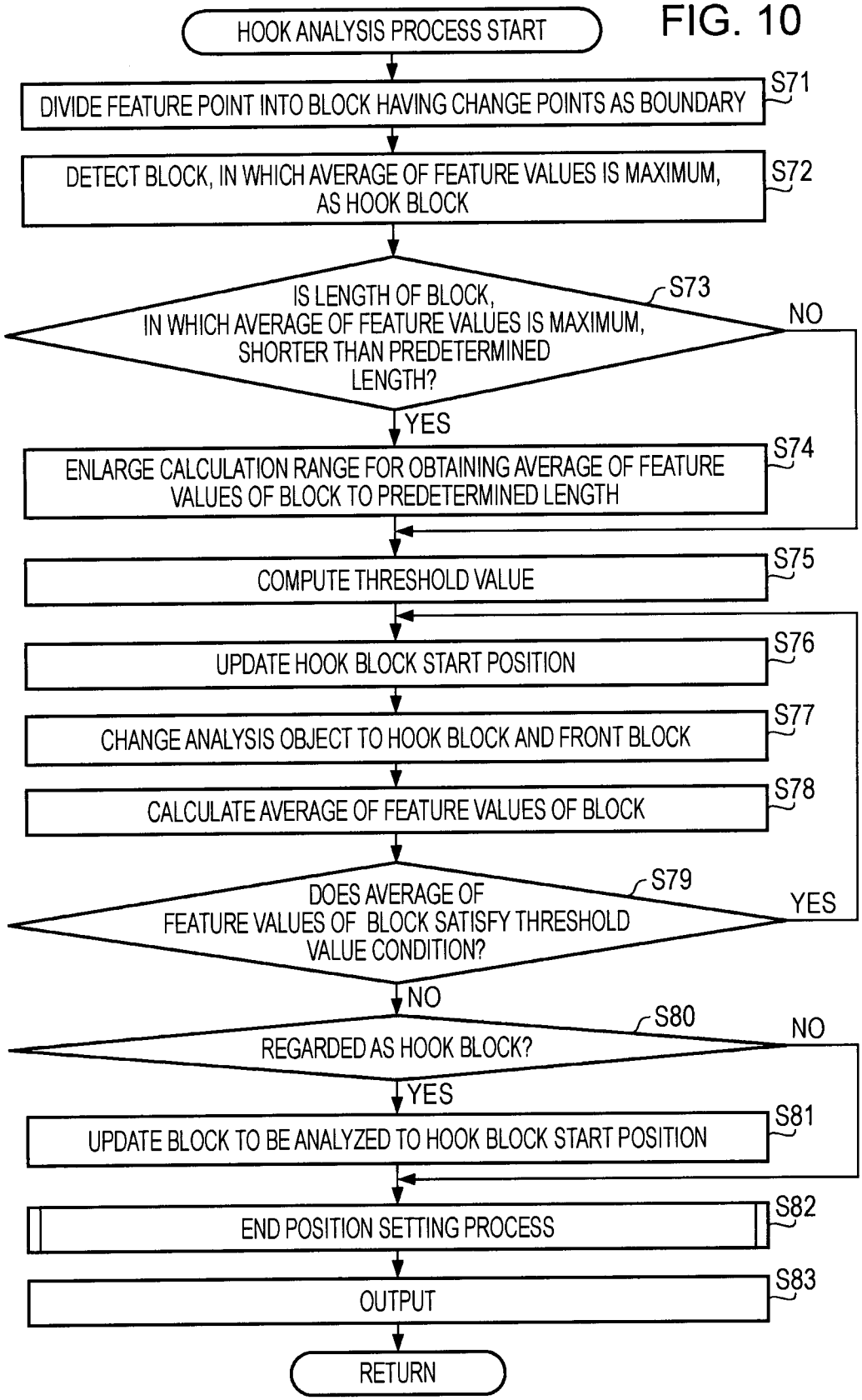
FIG. 10 is a flowchart illustrating a hook analysis process.

Now, the hook analysis process will be described with reference to the flowchart of FIG. 10.

In step S71, the block division unit 71 divides the time-series normalization feature value into blocks having a change point as a boundary and divides the time-series normalization feature value into block units.

In step S72, the hook block detection unit 72 obtains the average value of the time-series normalization feature value in block units and detects a block having a maximum value as a hook block. That is, if the audio signal level is the feature value, since the "hook" has a music property that the audio signal level thereof is greater than that of the "Melody A" or the "interlude", the block in which the average of the time-series normalization feature value is maximum is detected as a hook block.

In step S73, the hook block detection unit 72 determines whether or not the length of the block in which the average of the time-series normalization feature value divided into block units is maximum is shorter than a predetermined length and supplies the determination result to the hook block control unit 73.

If it is determined that the length of the block in which the average of the time-series normalization feature value is maximum is shorter than the predetermined length in step S73, that is, if it is regarded that the block in which the average of the time-series normalization feature value is maximum is extremely short and the average of the time-series normalization feature value is very large, the process progresses to step S74.

In step S74, the hook block control unit 73 increases the length of the block in which the average of the time-series normalization feature value is maximum to a predetermined length and sets the average of the time-series normalization feature value obtained from the length of the block increased to the predetermined length as the average of the time-series normalization feature value of that block.

Figure 11:
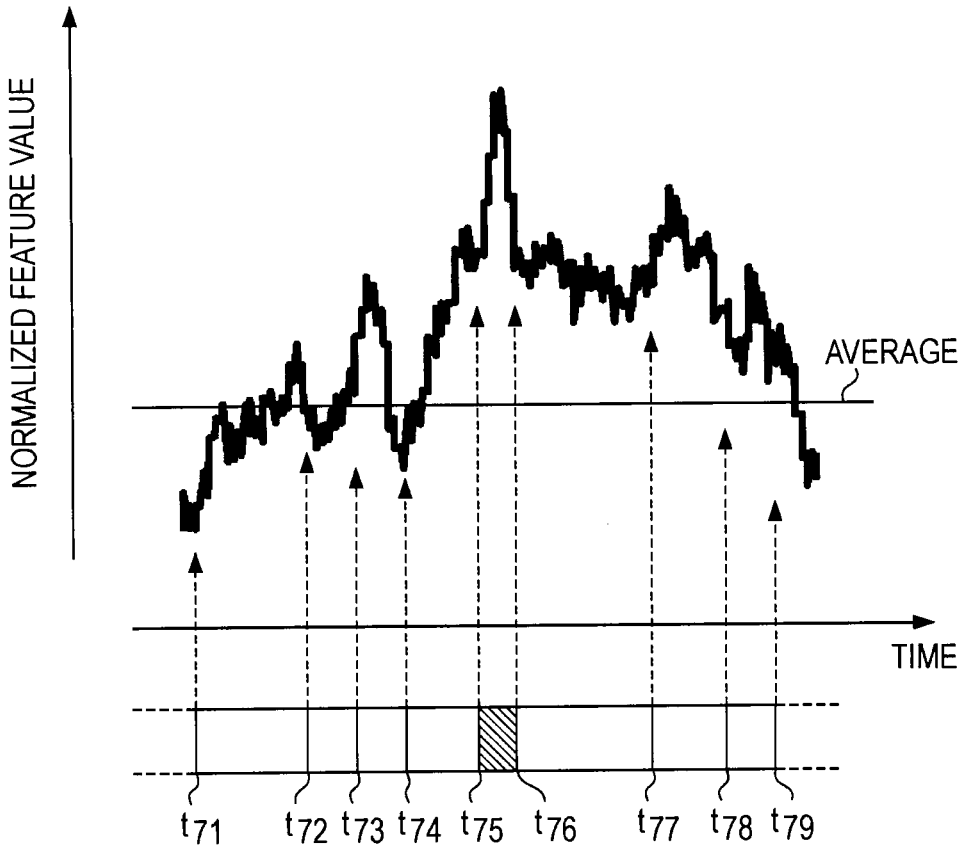
FIG. 11 is a diagram illustrating the hook analysis process.

That is, for example, the average of the time-series normalization feature value of the block of the times t75 to t76 of FIG. 11 becomes a maximum value, but the length of the block becomes less than the predetermined time. Thus, a very large change occurs. In this case, the average value of the block unit becomes greater than that of other blocks, and the threshold value condition described blow becomes stricter than necessary and disturbs the detection of the hook start position. Accordingly, if the block length is less than the predetermined threshold value, the calculation object of the feature value average widens to a predetermined range, thereby reducing such an adverse effect. The threshold value and the range of the calculation object of the feature value average may be changed according to tempo. In FIG. 11, times t71 to t79 located at the lower side of the waveform diagram are timings obtained as change points, each interval is divided as a block, and a block of times t75 to t76 is detected as a hook block.

If it is determined that the length of the block in which the average of the time-series normalization feature value is maximum is not shorter than the predetermined length in step S73, the process of step S74 is skipped and the process progresses to step S75 after the process of step S73.

In step S75, the hook block control unit 73 calculates the threshold value Vth based on the difference between the maximum value of the average of the time-series feature value of the block unit shown in the above-described Equation 7 and the average value of the feature value of the entire audio signal of the musical piece, based on the information about the hook block.

In step S76, the hook block control unit 73 updates the information about the start position of the hook block, based on the information about the hook block. The hook block control unit 73 supplies the average value of the time-series normalization feature value of each block unit, the hook block, each block, information about each time-series normalization feature value, information about the start position of the hook block and the threshold value Vth to the block analysis unit 74, for each type.

Figure 12:
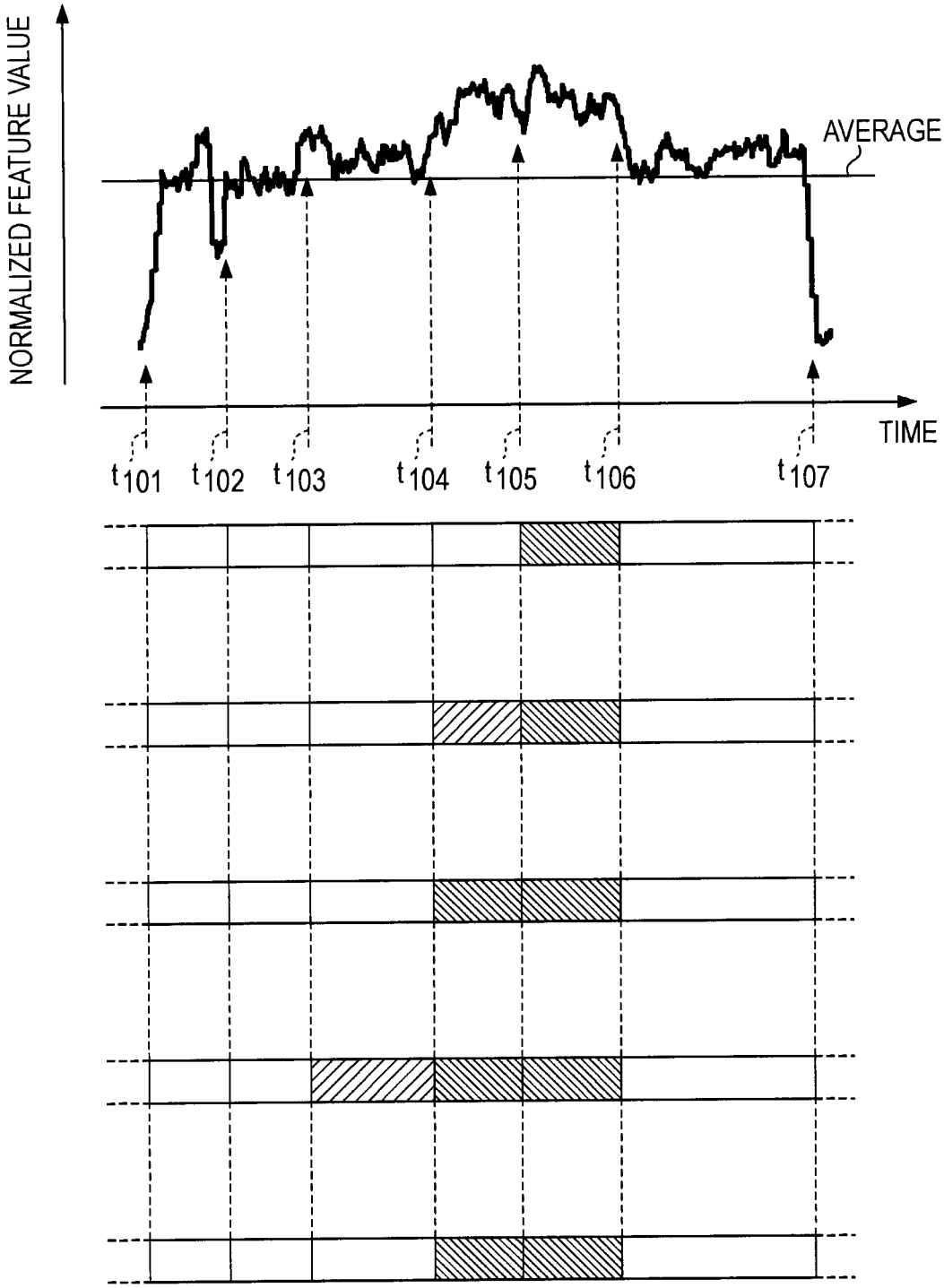
FIG. 12 is a diagram illustrating the hook analysis process.

That is, for example, if there is a waveform of a time-series normalization feature value shown in the upper side of FIG. 12, a block is set in each interval of times t101 to t107 under the waveform, and a block of the times t105 to t106 is detected as a hook block, the hook block control unit 73 updates the time t105 which is the leading position of the block of the times t105 to t106 of the hook block as the start position of the hook block. In FIG. 12, a right downward slope is a hook block and white blocks are other blocks.

In step S77, the hook block analysis unit 74 sets the block of the timing temporally preceding the start position of the hook block as the candidate for the leading block of the hook block to an analysis object. The hook block analysis unit 74 supplies the average value of the time-series normalization feature value of each block unit, the hook block, each block, information about each time-series normalization feature value, the start position of the hook block, information about the block of the analysis object and the threshold value Vth to the hook block determination unit 75, for each type.

In step S78, the hook block determination unit 75 obtains the average value of the time-series normalization feature value of the block of the analysis object which is the candidate for the leading block.

In step S79, the hook block determination unit 75 determines whether or not the difference between the average value of the time-series normalization feature value of the block of the analysis object and the average value of the feature value of the entire audio signal of the musical piece is greater than the threshold value Vth and the threshold value condition is satisfied.

In step S79, for example, as shown in a third stage from the top of FIG. 12, in the case where a block of times t104 to t105 represented by a right upward slope is a block of the analysis object, when the difference between the average value of the time-series normalization feature value and the average value of the feature value of the entire audio signal of the musical piece is greater than the threshold value Vth and the threshold value condition is satisfied, the process returns to step S76.

That is, in this case, in step S76, the hook block includes two blocks of times t104 to t106 represented by the right downward slope as shown in a fourth stage of FIG. 12 and the start position thereof is updated to a time t104. At this time, in step S77, as shown in a fifth stage of FIG. 12, a block of times t103 to t104 is set as an analysis object.

Meanwhile if the difference between the average value of the time-series normalization feature value and the average value of the feature value of the entire audio signal of the musical piece is less than the threshold value Vth and the threshold value condition is not satisfied in step S79, the process progresses to step S80.

In step S80, the hook block determination unit 75 supplies the average value of the time-series normalization feature value of each block unit, the hook block, each block, information about each time-series normalization feature value, the start position of the hook block, information about the block of the analysis object and the threshold value Vth to the hook block correction unit 76, for each type. The hook block correction unit 76 specifically determines whether or not the block of the analysis object is a hook block. That is, when "a block just before a hook" transitions to a "hook", the audio signal level is gradually increased. In this case, if the block of the analysis object includes a transition place, the average of the time-series normalization feature value may be decreased. In consideration of such an adverse effect, the hook block correction unit 76 excludes the time-series normalization feature value in the vicinity of the leading block from the calculation object for obtaining the average, obtains a correction average of the time-series normalization feature value of the block of the analysis object, and determines whether it is a hook block depending on whether the threshold value condition is satisfied by comparison with the threshold value Vth.

If it is regarded that the difference between the correction average of the time-series normalization feature value of the block of the analysis object and the average value of the feature value of the entire audio signal of the musical piece is greater than the threshold value Vth and the threshold value condition is satisfied in step S80, the process progresses to step S81.

In step S81, the hook block correction unit 76 updates and stores the block of the analysis object to the leading position of the hook block.

If it is regarded that the difference between the correction average of the time-series normalization feature value of the block of the analysis object and the average value of the feature value of the entire audio signal of the musical piece is less than the threshold value Vth and the threshold value condition is not satisfied in step S80, as shown in a sixth stage of FIG. 12, the block of times t103 to t104, which is the candidate, is not regarded as the hook block. Then, the process of step S81 is skipped.

In step S82, the hook analysis unit 35 executes the end position setting process and sets the end position of the hook block by the same method as the above-described method of determining the start position of the hook block. With respect to the end position setting process of the hook block, this is performed by the same method as the process of steps S75 to S81 except for the setting of the analysis object block in a time flowing direction and a description thereof will be omitted.

In step S83, the hook block correction unit 76 outputs information about the leading position and end position of the obtained hook block to the hook unification unit 36.

By the above process, the information about the start position and end position of the hook block is obtained from the block in which the average value of the block unit becomes a maximum value among the time-series normalization feature values. If plural types of time-series normalization feature values are used, the information about the start position and end position of the hook block is obtained for each type of the time-series normalization feature value.

Here, the description returns to the flowchart of FIG. 4.

In step S5, the information about the start position and end position of the hook block is obtained for each type of the time-series normalization feature value by the hook analysis process and is supplied to the hook unification unit 36.

In step S6, the hook unification unit 36 acquires the information about the start position and end position of the hook block for each type of the time-series normalization feature value supplied from the hook analysis unit 35 and unifies a plurality of hook blocks. More specifically, the hook unification unit 36 outputs the hook block obtained by a feature value with highest reliability using a threshold value or the like as an index as a unification result, because, if the threshold value Vth used to determine whether or not it is the hook block is small, the reliability of the detected block being a hook tends to be decreased. Since which type of feature value is valid in hook analysis is previously known, the hook unification unit 36 may determine a priority of employment in order of feature values which are valid in hook analysis in advance and output the detection result by other feature values only when reliability is low using the threshold value or the like as an index. If the number of types of the time-series normalization feature values is 1, this process is skipped.

In step S7, the hook unification unit 36 outputs information about the unified hook block.

As described above, the time-series normalization feature value is set for each frame, the moving average of each time-series normalization feature value is obtained, a position greater than a predetermined amount of change from the amount of change of a frame unit is obtained as a change point, a section between the change points is set as a block, the average of the time-series normalization feature values is obtained in block units, a block in which the average becomes a maximum value is detected as a hook block, and the start position and end position of the detected hook block is obtained, thereby detecting the range of the hook block. As a result, it is possible to accurately obtain the hook based on a trend that the audio signal level is increased.

Although the block in which the average of the time-series feature values is maximum is detected as the hook block, a block in which the average of the time-series feature values is minimum may be detected in the case of using a time-series feature value of a type having a property that the "hook" is less than that the "Melody A" or "interlude". In this case, by reversing the positive/negative polarity of the time-series feature value, the common process may be performed.

According to the present disclosure, it is possible to extract the hook with high accuracy and enhance search performance of a musical piece desired by the user. In addition, it is possible to continuously reproduce hooks of a plurality of musical pieces using a change point of an audio signal as a start point.

As described above, since a simple processing structure may be realized, it is possible to perform a high-speed process even in a processor with low throughput. In addition, mounting is easy. In addition, since a repeated pattern of a musical piece is not considered, an autocorrelation process for similarity calculation is unnecessary and a higher speed is realized by excluding a second half of the musical piece from the analysis object.

The present disclosure is used as an application having a musical piece searching function or a function for continuously reproducing hooks of a plurality of musical pieces.

The above-described series of processes may be executed by hardware or software. If the series of processes is executed by software, a program configuring the software is installed in a computer in which dedicated hardware is mounted or, for example, a general-purpose personal computer which is capable of executing a variety of functions by installing various types of programs, from a recording medium.

Figure 13:
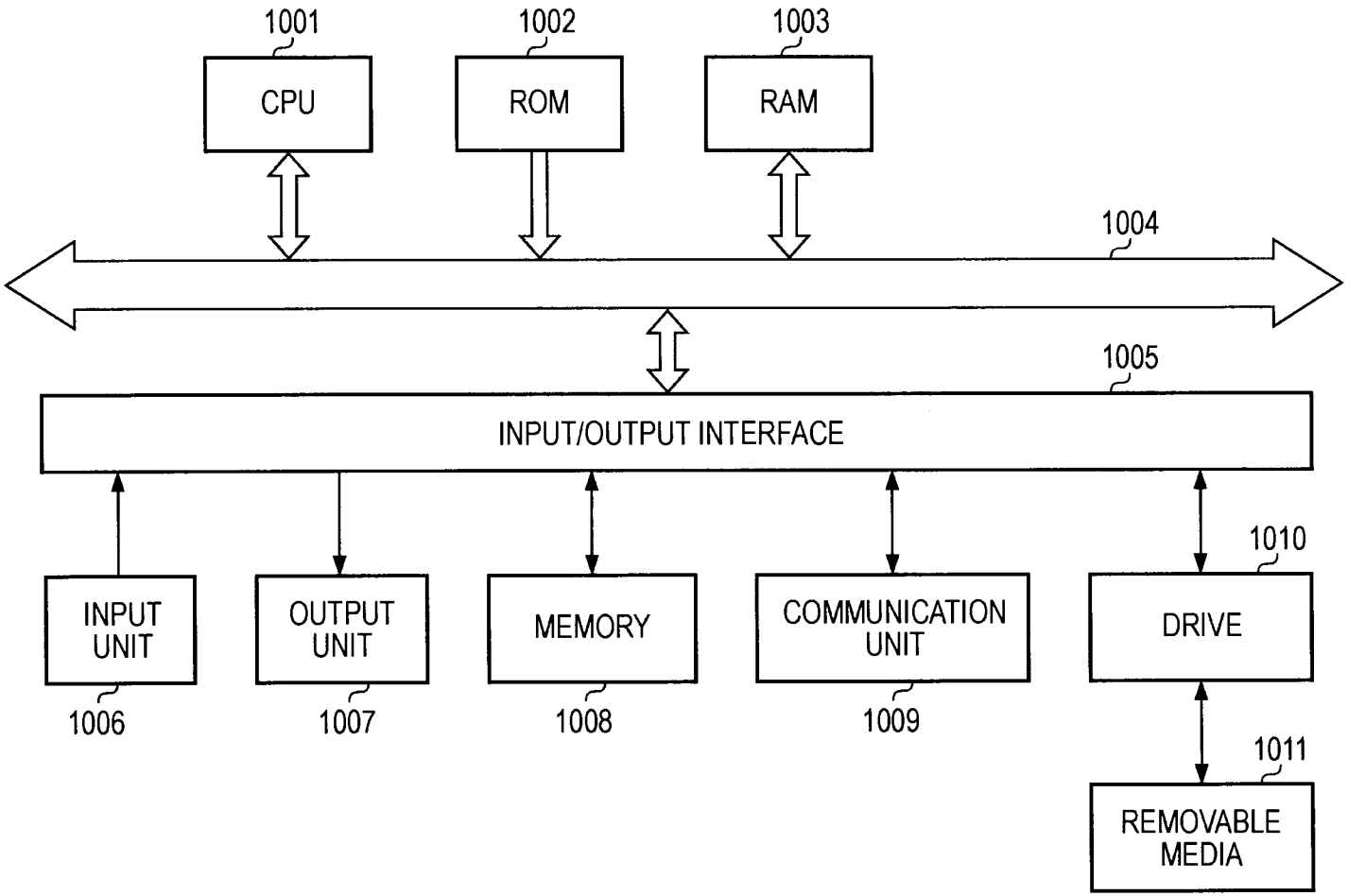
FIG. 13 is a diagram illustrating a configuration example of a general-purpose personal computer.

FIG. 13 shows a configuration example of a general-purpose personal computer. This personal computer includes a Central Processing Unit (CPU) 1001 mounted therein. An input/output interface 1005 is connected to the CPU 1001 via a bus 1004. A Read Only Memory (ROM) 1002 and a Random Access Memory (RAM) 1003 are connected to the bus 1004.

An input unit 1006 including an input device for enabling a user to input a manipulation command, such as a keyboard or a mouse, an output unit 1007 for outputting a processing manipulation screen or an image of a processed result to a display device, and a storage unit 1008 for storing a program and a variety of data, such as a hard disk, and a communication unit 1009 for executing a communication process via a network representative of the Internet, such as a Local Area Network (LAN) adapter are connected to the input/output interface 1005. A drive 1010 for reading and writing data from and to a removable media 1011 such as a magnetic disk (including a flexible disk), an optical disc (a Compact Disc-Read Only Memory (CD-ROM), a Digital Versatile Disc (DVD), or the like), a magneto-optical disc (including Mini Disc (MD)) or a semiconductor memory is connected.

The CPU 1001 executes a variety of processes according to a program stored in the ROM 1002 or a program read from the removable media 1011 such as the magnetic disk, the optical disc, the magneto-optical disc or the semiconductor memory, installed in the storage unit 1008, and loaded from the storage unit 1008 to the RAM 1003. In the RAM 1003, data or the like necessary for executing the variety of processes by the CPU 1001 is appropriately stored.

In the present specification, steps describing a program recorded on a recording medium may include a process performed in time series in the order described therein or a process performed in parallel or individually.

The present disclosure contains subject matter related to that disclosed in Japanese Priority Patent Application JP 2010-233908 filed in the Japan Patent Office on Oct. 18, 2010 and Japanese Priority Patent Application JP 2011-037393 filed in the Japan Patent Office on Feb. 23, 2011, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An audio processing apparatus comprising:

an audio signal acquisition unit configured to acquire an audio signal of a musical piece;

a feature value extraction unit configured to extract a predetermined type of feature values from the audio signal acquired by the audio signal acquisition unit in time series;

a change point detection unit configured to detect a change point in which the amount of change of the feature values extracted in time series by the feature value extraction unit is changed to be greater than a predetermined threshold value;

a hook analysis unit configured to analyze a hook place of the audio signal based on the feature values extracted by the feature value extraction unit in block units with the change point detected by the change point detection unit as a boundary; and a hook information output unit configured to output the hook place analyzed by the hook analysis unit as hook information, wherein the change point detection unit includes:

a smoothing unit configured to smooth the feature values of the time series;

a change amount calculation unit configured to calculate the amount of change;

a change point determination unit configured to determine whether or not the amount of change is the change point;

a change point detection control unit configured to control a calculation place of the amount of change and record the position of the change point if the change point is detected; and a change point unification unit configured to unify a plurality of change points.

2. The audio processing apparatus according to claim 1, wherein the type of feature value includes any one of a root mean square of a stereo sum signal, a root mean square of a stereo difference signal, a square sum of an amplitude of a stereo sum signal and a square sum of an amplitude of a stereo difference signal or a combination thereof.

3. The audio processing apparatus according to claim 1, wherein the change point detection unit further includes a normalization unit configured to normalize the feature values of the time series.

4. The audio processing apparatus according to claim 1, wherein the change point detection unit includes a change point redetection unit configured to execute any one or both of a process of changing the predetermined threshold value so as to decrease the number of change points if the number of change points is greater than the predetermined threshold value by comparison of the number of change points and the predetermined threshold value and a process of smoothing the feature values of the time series again by the smoothing unit and determining whether or not the amount of change is the change point again.

5. The audio processing apparatus according to claim 1, wherein the change point detection unit includes a change point redetection unit configured to change the predetermined threshold value so as to increase the number of change points and determine whether or not the amount of change is the change point again, if a period greater than a predetermined time and without the change point is present.

6. The audio processing apparatus according to claim 1, wherein the smoothing unit smoothes the feature values of the time series by a moving average in a predetermined period.

7. The audio processing apparatus according to claim 6, wherein the smoothing unit smoothes the feature values of the time series by the moving average in the predetermined period based on a tempo obtained in advance.

8. The audio processing apparatus according to claim 1, wherein the change point detection unit includes a change point adjustment unit configured to unify a plurality of adjacent change points among the change points.

9. The audio processing apparatus according to claim 8, wherein the change point detection unit includes a change point adjustment unit configured to unify two adjacent change points among the change points to a middle point.

10. The audio processing apparatus according to claim 1, wherein the audio signal acquisition unit outputs an MDCT coefficient of the acquired audio signal of the musical piece.

11. An audio processing apparatus comprising:

an audio signal acquisition unit configured to acquire an audio signal of a musical piece;

a feature value extraction unit configured to extract a predetermined type of feature values from the audio signal acquired by the audio signal acquisition unit in time series;

a change point detection unit configured to detect a change point in which the amount of change of the feature values extracted in time series by the feature value extraction unit is changed to be greater than a predetermined threshold value;

a hook analysis unit configured to analyze a hook place of the audio signal based on the feature values extracted by the feature value extraction unit in block units with the change point detected by the change point detection unit as a boundary; and a hook information output unit configured to output the hook place analyzed by the hook analysis unit as hook information, wherein the hook analysis unit includes:

a block division unit configured to perform division into blocks having the change points as boundaries;

a hook block detection unit configured to obtain an average of the feature values in block units and detect a block, in which the average of the feature values is maximum, as a hook block;

a hook block control unit configured to control the position of a block of an analysis object based on a restriction that a block continues to the hook block detected by the hook block detection unit;

a hook block analysis unit configured to analyze the block of the analysis object; and a hook block determination unit configured to determine whether or not the block of the analysis object is a hook block based on the analysis result of the hook block analysis unit.

12. The audio processing apparatus according to claim 11, wherein the hook block detection unit sets the average of the feature value obtained by widening a calculation range of the average of the feature values of the block unit to a predetermined length longer than the block as the average of the feature value, if the block, in which the average of the feature value is maximum, is less than a predetermined period.

13. The audio processing apparatus according to claim 11, wherein the hook block analysis unit analyzes the block of the analysis object and obtains and sets the average of the feature value in the block of the analysis object as the analysis result, and wherein the hook block determination unit computes a predetermined threshold value based on a difference between the average of the feature value in the hook block detected by the hook block detection unit and the average of the feature value of the entire audio signal of the musical piece acquired by the audio signal acquisition unit, and determines whether the block of the analysis object is a hook block by comparison of the difference between the average of the feature value of the block of the analysis object and the average of the feature value of the entire audio signal of the musical piece and the threshold value.

14. The audio processing apparatus according to claim 13, wherein the hook block analysis unit includes a hook block correction unit configured to correct the predetermined threshold value to be small, analyze the block of the analysis object again and determine whether or not the block of the analysis object is the hook block, if it is determined that the block of the analysis object is not the hook block by the hook block determination unit.

15. The audio processing apparatus according to claim 13, wherein the hook block analysis unit includes a hook block correction unit configured to correct the number of samples of the block of the analysis object to be reduced, analyze the block of the analysis object again and determine whether or not the block of the analysis object is the hook block, if it is determined that the block of the analysis object is not the hook block by the hook block determination unit.

16. The audio processing apparatus according to claim 11, further comprising a hook information unification unit configured to unify hook information by plural predetermined types of feature values.

17. An audio processing method comprising:

acquiring an audio signal of a musical piece;

extracting a predetermined type of feature value from the acquired audio signal in time series;

detecting a change point in which the amount of change of the feature value extracted in time series is changed to be greater than a predetermined threshold value, wherein the feature values of the time series are smoothed, the amount of change is calculated, whether or not the amount of change is the change point is determined, a calculation place of the amount of change is controlled, the position of the change point is recorded if the change point is detected, and a plurality of change points is unified;

analyzing a hook place of the audio signal based on the extracted feature value in block units with the detected change point as a boundary; and outputting the analyzed hook place as hook information.

18. A non-transitory computer-readable medium having embodied thereon a program, which when executed by a computer causes the computer to perform an audio processing control method, the method comprising:

acquiring an audio signal of a musical piece;

extracting a predetermined type of feature value from the acquired audio signal in time series;

detecting a change point in which the amount of change of the feature value extracted in time series is changed to be greater than a predetermined threshold value, wherein the feature values of the time series are smoothed, the amount of change is calculated, whether or not the amount of change is the change point is determined, a calculation place of the amount of change is controlled, the position of the change point is recorded if the change point is detected, and a plurality of change points is unified;

analyzing a hook place of the audio signal based on the extracted feature value in block units with the detected change point as a boundary; and outputting the analyzed hook place as hook information.

* * * * *